US005613869A

United States Patent [19]

Erlich et al.

[11] Patent Number: 5,613,869

[45] Date of Patent: Mar. 25, 1997

[54] MODULAR CONNECTOR FOR A COMMUNICATION LINE

[75] Inventors: Ron Erlich, Bridgeport, Conn.; Charles Thayer, Brooklyn, N.Y.

[73] Assignee: The Trustees of Columbia University in the City of New York, New York, N.Y.

[21] Appl. No.: 438,768

[22] Filed: May 11, 1995

[51] Int. Cl.[6] ..... H01R 4/50; H01R 13/627

[52] U.S. Cl. ..... 439/344; 439/354

[58] Field of Search ..... 439/344, 353, 439/354, 357, 358, 676, 736

[56] References Cited

U.S. PATENT DOCUMENTS

| | | | |
|---|---|---|---|
| 4,103,985 | 8/1978 | Krolak et al. | 439/367 |
| 4,268,109 | 5/1981 | Hardesty | 439/638 |
| 4,379,609 | 4/1983 | Hardesty | 439/344 |
| 4,615,575 | 10/1986 | Kossor | 439/304 |
| 5,118,310 | 6/1992 | Stroede et al. | 439/676 |
| 5,462,457 | 10/1995 | Schroepfer et al. | 439/352 |

OTHER PUBLICATIONS

Extract from 37 C.F.R. §68.500 (1988), pp. 168–187.

*Primary Examiner*—P. Austin Bradley
*Assistant Examiner*—Yong Kim
*Attorney, Agent, or Firm*—Brumbaugh, Graves, Donohue & Raymond

[57] ABSTRACT

Disclosed is a modular connector for a communication line. The inventive connector includes a body having a terminal side for inserting into a corresponding jack and a cable side for fastening to an end of the communication line. The connector also includes a spring-biased tab which has a first end connected to the terminal side of the body and a second free end. The tab has a pair of oppositely extending locking shoulders spaced from the free end of the resilient tab. The tab is movable for operatively engaging and disengaging the locking shoulders with corresponding internal abutting surfaces within the jack to secure and release the connector from the jack. A guard extends from the cable side of the body towards the terminal side of the body. At least a portion of the second free end of the tab is covered by a section of the guard for preventing the tab from catching another communication line or other object when its associated line is removed from the jack.

5 Claims, 4 Drawing Sheets

MODULAR CONNECTOR FOR A COMMUNICATION LINE

FIELD OF THE INVENTION

This invention relates to modular connectors for telephone and other communication lines and, more particularly, to an improved modular connector whose tab will not snag or catch other communication lines or objects when the connector and its associated communication line are removed from equipment having a multiplicity of other relatively closely spaced communication lines.

BACKGROUND OF THE INVENTION

Modular connectors are known in the art and are in widespread use to facilitate a connection between one communication line, such as a telephone line, with another communication line or system. Such connectors are plug-like devices which are fastened to the end of a communication line; their other end is typically secured to a jack. Jacks are devices which are wired to an external communication network or system, and they are generally secured at one location. Each jack has an opening for engaging its corresponding connector. In operation, the modular connector is plugged into the opening in the jack to complete the connection to the communication network or system. Modular connectors and jacks used in the United States must comply with the specifications published by the FCC in 47 CFR § 68,500. The jacks are typically of the RJ-11, RJ-12 and RJ-45 family. Today, modular connectors and jacks are also used for computer and other types of systems to make it very easy for anyone to connect and disconnect a communication line to another communication line or system.

Many of today's communication systems have central hubs, or switch locations which include patch panels or other telecommunications equipment having a multiplicity of relatively closely spaced modular jacks. The jacks are typically arranged relatively closely together. When a communication line is disconnected from the patch panel, its connector is first released from a corresponding jack, and the line is pulled out from among the other lines. Once the connector is released, the tab of the connector forms a hook-like configuration which points obliquely away from the body of the connector. As the communication line is being pulled out, its associated tab often catches or snags another line or other object, and this causes the line to become entangled. Frequently, in these situations, the tab breaks off due to the force exerted by the individual pulling the line. Accordingly, while the conventional modular connector is a useful component that works quite well when the communication lines and jacks are spaced relatively far apart, it does have the above-described problem of the tendency to create snags when the lines and jacks are positioned in close proximity with one another.

Therefore, a need clearly exists for an improved modular connector which will not catch or snag other communication lines or objects when the modular connector and its associated communication line is being removed from equipment having a multiplicity of lines in close proximity to one another.

SUMMARY OF THE INVENTION

In accordance with the present invention, a modular connector for a communication line includes a body which has a terminal side for inserting into the opening of a corresponding jack and a cable side for fastening to the end of the communication line. The body includes a plurality of contacts which engage corresponding contacts located within the jack. The body also has a resilient or spring-biased tab which has a first end connected to the terminal side of the body and a second free end which extends toward the cable side of the body. The first end of the tab extends obliquely outward from the body, while the second free end of the tab extends obliquely inward toward the body. The tab includes a pair of oppositely extending locking shoulders which are spaced from the second free end. The locking shoulders are operatively engaged and disengaged from corresponding internal abutting surfaces within the jack to secure and release the connector from the jack. The resilient or spring-biased nature of the tab forces the second free end of the tab away from the body.

The body also has a guard which extends from the cable side of the body toward the terminal side of the body. A portion of the second free end is covered by a section of the guard in order to prevent the second free end from catching another communication line or other object when the connector and its associated communication line are removed from the panel.

When the tab is not being depressed, a section of the free end is in contact with the underside of the guard. When the tab is depressed, the locking shoulders are disengaged from the internal abutting surfaces within the jack.

The body of the connector has a recess formed by a first side wall and a second side wall. The second free end is partially disposed within the recess in order to prevent the tab from catching or snagging adjacent communication lines or other objects when the connector is removed from the panel.

Other objects, features, and advantages of the invention will be apparent to those skilled in the art from a study of the attached drawings and detailed description hereinafter.

DETAILED DESCRIPTION OF THE INVENTION

Figure 1:
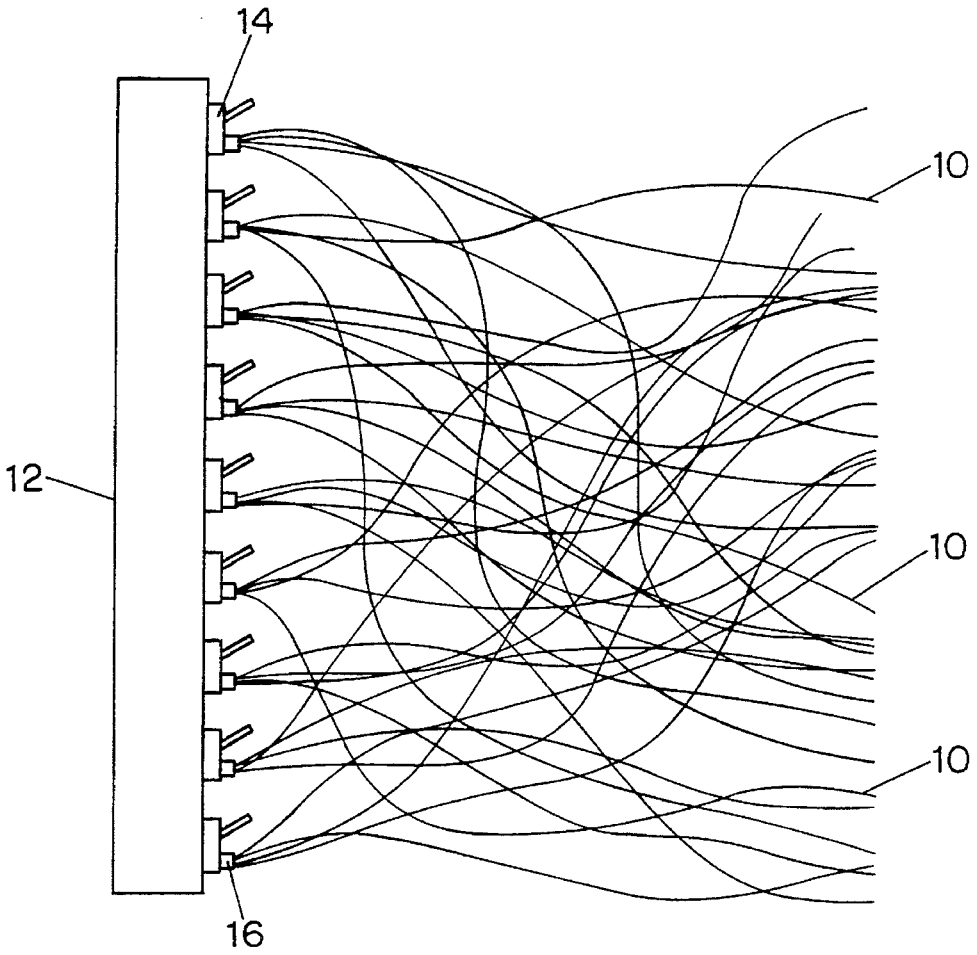
FIG. 1 is a side view of a patch panel for communication equipment having a multiplicity of communication lines connected to the panel.
Figure 2:
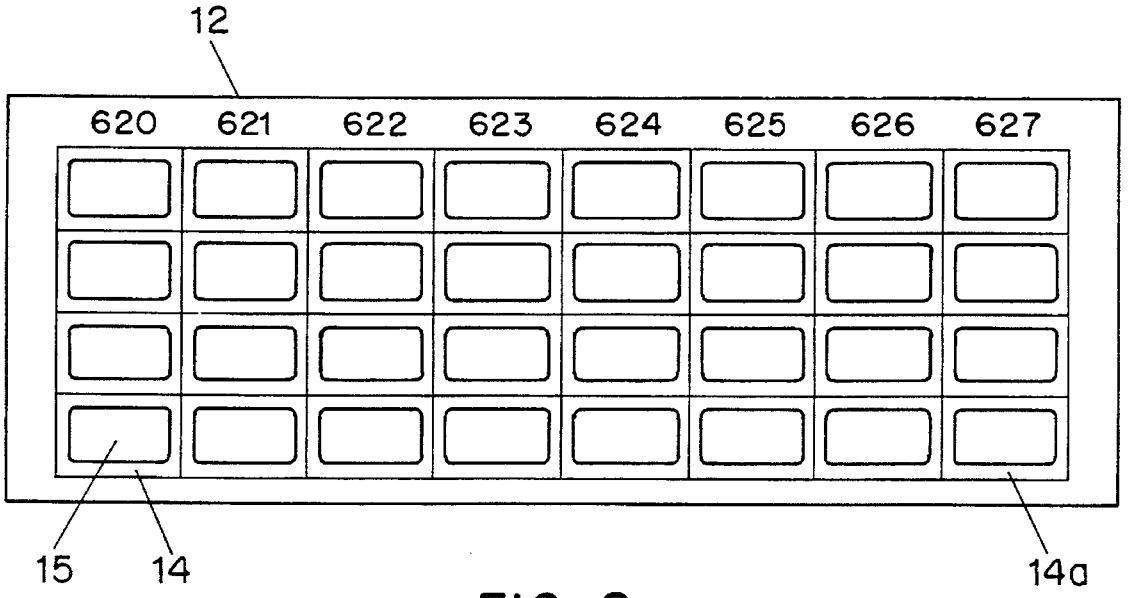
FIG. 2 is a partial front view of the patch panel in FIG. 1.

FIGS. 1 and 2 show one environment in which the above-identified problems can occur. In many types of commonly used equipment, such as telephone switches, all of the communication lines 10 that are connected to the system are brought together at one central location or hub, where the lines 10 are connected to a jack panel or rack 12. The individual jacks 14 are typically of the RJ-11, RJ-12, and RJ-45 type. The design of the connectors must, at a minimum, satisfy the requirements of the FCC published in 47 CFR § 68,500.

Figure 3:
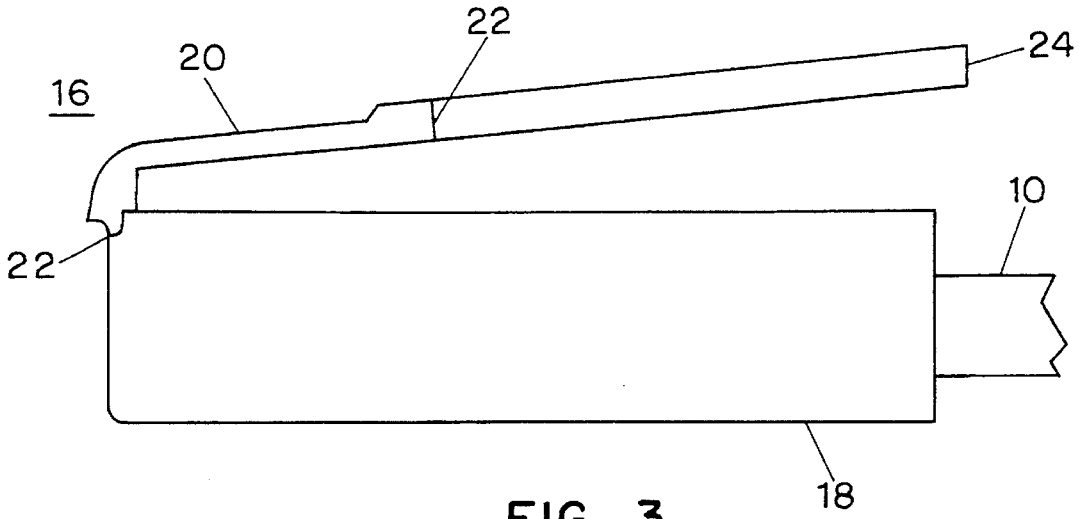
FIG. 3 PRIOR ART
FIG. 3 is a side view of a prior art modular connector.

As shown in FIGS. 1–3, an array of communication jacks 14 are arranged next to one another on the panel 12. Each jack 14 has an opening 15 for accepting a corresponding connector 16.

FIG. 3 shows a side view of a conventional modular connector 16 used for connecting a communication line 10 to a modular jack 14. The connector 16 is secured to the end of the communication line 10 which in turn enables the communication line to be connected to the panel 12. The connector 16 includes a body 18, a substantially flat spring-biased tab 20, and a plurality of terminals (not shown) mounted in the body for transferring communication signals from the communication line 10 to the wires within the jack 14. The tab 20, in its normal orientation, extends obliquely outward from a connection point 22 with the connector body 18. When an operator desires to remove the line 10 from the panel 12, he must first depress the tab 20 on the connector 16 to disengage one or more shoulders 22 on the tab 20 from internal ledges within the jack 14. Once the shoulders 22 have been disengaged from the internal ledges within the jack 14, the communication line 10 is available for movement to another jack 14*a*. More importantly, after the tab 20 is depressed, and while the line 10 is being removed, the orientation of the tab 20 out and away from the body 18 makes it highly susceptible to damage because a free end 24 of the tab 20 can easily catch or snag other communication lines 10 or other objects as the line 10 is being pulled away from the panel 12. Frequently, in these situations, the tab breaks off the body 18 due to force exerted by the individual pulling the line 10. Once the tab 20 breaks, the connector 16 can no longer be properly secured to its assigned jack 14 and the entire connector 16 must be replaced. This creates a problem, because replacing a connector 16 can be costly and time consuming.

Figure 4:
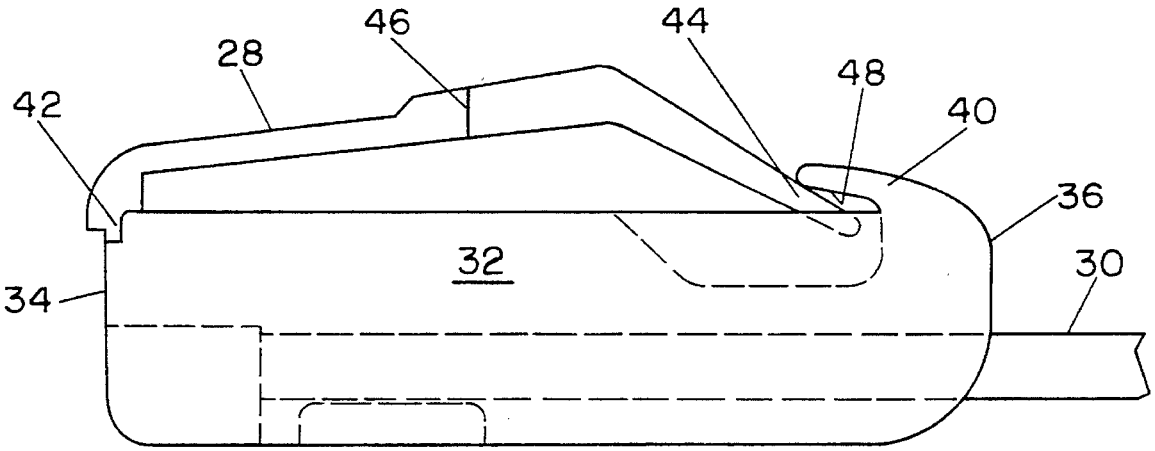
FIG. 4 is a side view of the inventive modular connector.
Figure 5:
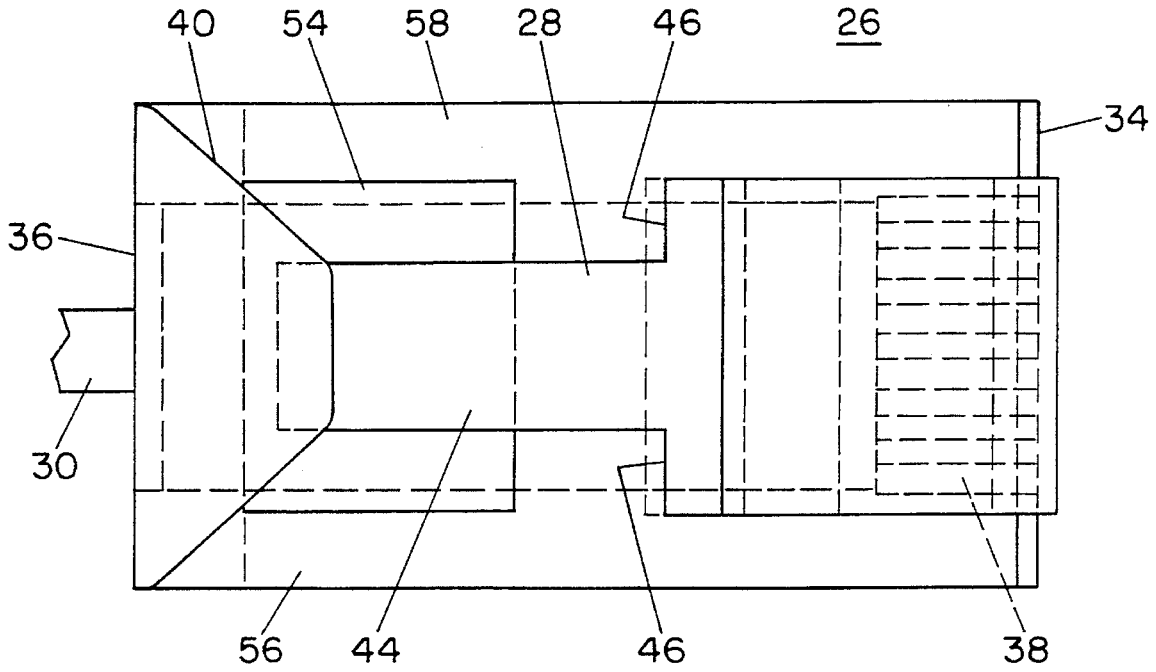
FIG. 5 is a top view of the inventive connector shown in FIG. 4.
Figure 6:
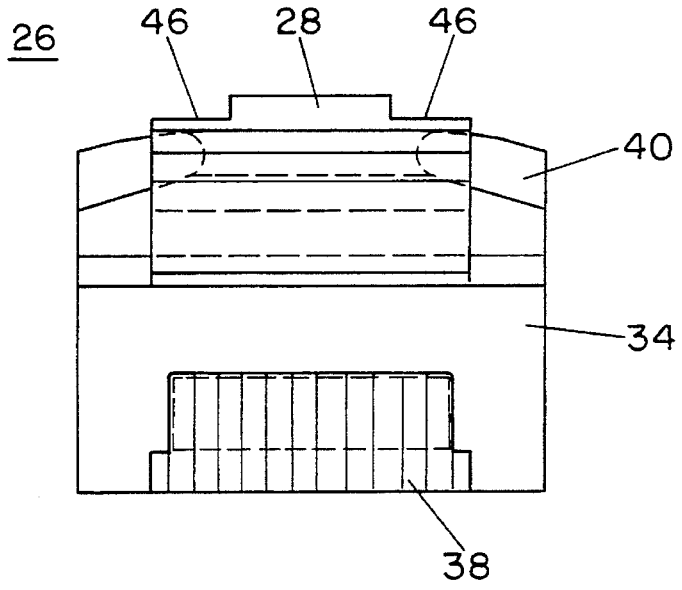
FIG. 6 is a terminal side view of the inventive connector shown in FIG. 4.
Figure 7:
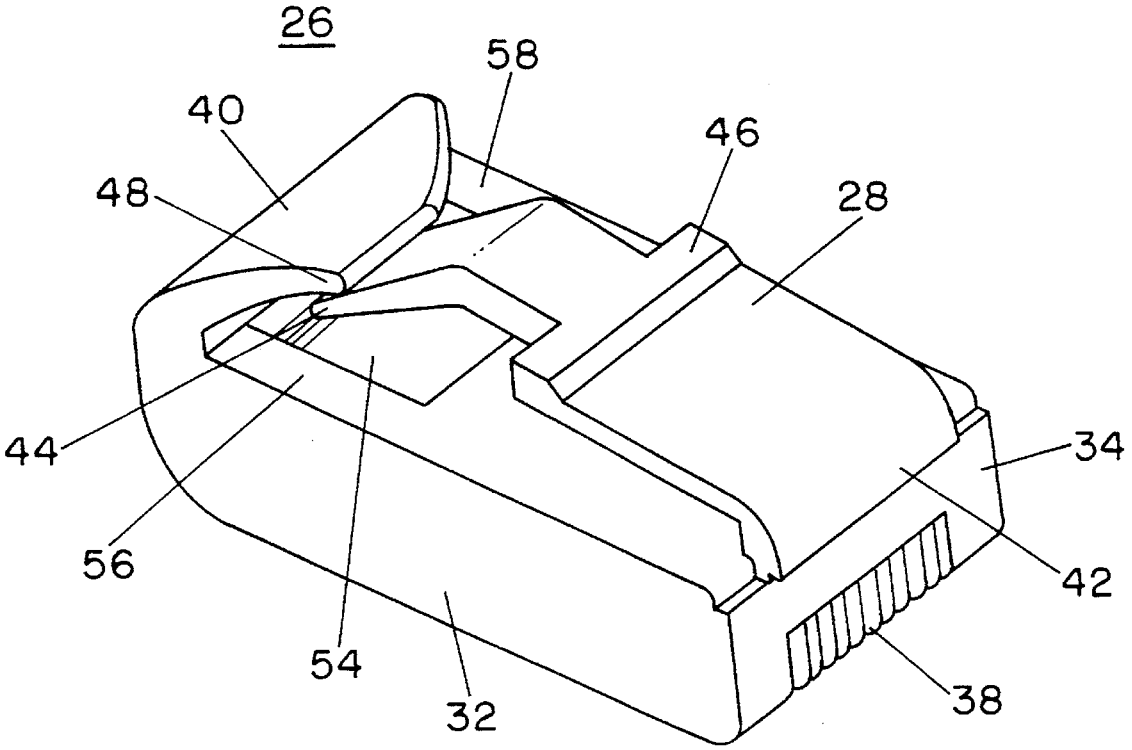
FIG. 7 is a perspective view of the inventive connector shown in FIG. 4.

Referring to FIGS. 4–7, the modular connector 26 of the present invention solves the above described problems by preventing the tab 28 from catching adjacent communication lines or other objects when the communication line 30 is being removed from its associated jack 14. Referring to FIG. 4, the inventive connector 26 includes a body 32 which has a terminal side 34 for being inserted into a jack and a cable side 36 for being fastened to the end of the communication line 30. Referring to FIGS. 5–7, a plurality of contacts 38 are disposed in the body 32 for engaging associated contacts within a jack opening in which the connector 26 is placed. The body 32 also has a guard 40 which extends from the cable side 36 of the body 32 towards the terminal side 34 of the body 32.

The inventive connector also includes the spring-biased tab 28 which has a first end 42 connected to the body 32 and a second free end 44 which extends toward the cable side 36 of the body 32. As shown in FIG. 4, an extension of the first end 42 of the tab 28 extends obliquely outward from the body 32 and the second free end 44 of the tab 28 extends obliquely inward toward the body 32. A pair of oppositely extending locking shoulders 46 are spaced from the second free end 44 of the tab 28. When the tab 28 is in its normal position, the resilient or spring-biased nature of the tab 28 forces the locking shoulders 46 into an engagement with corresponding internal abutting surfaces within the jack to thereby secure the connector 26 to the jack. When the tab 28 is depressed, the shoulders 46 disengage the internal abutting surfaces within the jack opening to release the connector 26 from the jack.

Referring to FIG. 7, the body 32 of the connector 26 has a recess 54 formed therein. The recess 54 is formed on top of the body 32 between a first side wall 56 and a second side wall 58 for further storing the second free end 44 within the contours of the body 32 and preventing the second free end 44 from catching another communication line or other object. Referring to FIG. 4, the tip of the second free end 44 is located within the recess 54.

Referring to FIGS. 4 and 5, during operation at least a portion of the second free end 44 of the tab 28 is under a section 48 of the guard 40. The section 48 is located on an underside of the guard 40. When the tab 28 is not depressed, at least a portion of the second free end 44 contacts the section 48 of the guard 40. When the tab 28 is depressed, the second free end 44 disengages from the section 48 of the guard 40. This configuration makes it highly improbable that objects will pass between the second free end 44 and the guard 40, and thereby prevents the tab 28 from catching a communication line or other object.

It will be understood that the principles of this invention are not limited to the specific examples given herein by way of illustration, but are applicable to modular-type connectors used with jacks in other parts of the telephone system, computer systems or other communication systems.

We claim:

1. A modular connector for a communication line comprising:

a body having a terminal side for inserting into a corresponding jack and a cable side for fastening to an end of the communication line;

a spring-biased tab having a first end connected to the terminal side of the body and a second free end extending toward the cable side of the body;

a pair of oppositely extending locking shoulders spaced from the free end of the resilient tab for operatively engaging and disengaging with corresponding internal abutting surfaces within the lack to thereby secure and release the connector therefrom; and a guard extending from the cable side of the body towards the terminal side of the body wherein at least a portion of the second free end of the tab is covered by a section of the guard and wherein the body has a recess formed by a first side wall and a second side wall for accepting the tip of the second free end and for preventing the second free end of the spring-biased tab from catching a communication line or other object.

2. The connector of claim 1, wherein the second free end has a portion for operatively engaging and disengaging with the section of the guard.

3. The connector of claim 2, wherein the first end of the spring-biased tab extends obliquely outward from the body and the second free end of the tab extends obliquely inward toward the body.

4. The connector of claim 1, wherein the locking shoulders are disengagable from the internal abutting surfaces within the jack when the tab is depressed.

5. A modular connector for a communication line which is insertable into a jack comprising:

a body having a terminal side for being inserted into the jack and a cable side for fastening to an end of the communication line;

tab means for operatively engaging and disengaging the connector from the jack; and a guard extending from the cable side of the body towards the terminal side of the body, wherein at least a portion of the tab means is covered by the guard for preventing the tab means from catching another communication line or other object and wherein the body has a recess formed by a first side wall and a second side wall for accepting said at least a portion of the tab means.

* * * * *